US005590554A

United States Patent [19]

Ho

[11] Patent Number: 5,590,554

[45] Date of Patent: Jan. 7, 1997

[54] ENDLESSLY CLOCKWISE/COUNTERCLOCKWISE IDLY ROTATABLE BURGULARPROOF DOOR LOCK

[76] Inventor: I-Hui Ho, No. 29, Alley 7, Lane 428, Chong-Cheng N. Rd,, San-Chong City, Taipei Hsien, Taiwan

[21] Appl. No.: 482,749

[22] Filed: Jun. 5, 1995

[51] Int. Cl.[6] ..... E05B 13/10; G05G 5/00

[52] U.S. Cl. ..... 70/221; 70/218

[58] Field of Search ..... 70/221, 222, 223, 70/149, 472, 218

[56] References Cited

U.S. PATENT DOCUMENTS

| | | | |
|---|---|---|---|
| 2,511,522 | 6/1950 | Williams | 70/221 |
| 3,808,849 | 5/1974 | Alexander | 70/149 |
| 3,896,644 | 6/1975 | Nagy et al. | 70/149 |
| 3,896,645 | 6/1975 | Nagy et al. | 70/149 |
| 4,108,482 | 8/1978 | Dietrich et al. | 292/165 |
| 4,631,944 | 12/1986 | Gater et al. | 70/472 |
| 4,739,638 | 4/1988 | Lin | 70/129 |
| 5,010,755 | 4/1991 | Best | 70/422 |

*Primary Examiner*—Steven N. Meyers
*Assistant Examiner*—Donald J. Lecher
*Attorney, Agent, or Firm*—Bacon & Thomas

[57] ABSTRACT

An endlessly clockwise/counterclockwise idly rotatable burglarproof door lock in which a rotary switch of a rotary switch assembly is formed with a central projecting hub on a front surface thereof. The projecting hub has a recess frame, a notch and an engaging socket. A circular hole is formed on the rotary switch beside the projecting hub. A lock core body is disposed in the projecting hub. A rotary plate and a pushing plate are disposed on the lock core body. A first steel ball is disposed in the notch and a second steel ball and a spring are disposed in the circular hole. A copper ring is disposed on the front surface of the rotary switch. A circular orbit and a semicircular engaging hole are formed on the bottom of the copper ring. An engaging block of the door lock body is formed with a hook-like front end and restrained by a spring, whereby the engaging block can control a pushing block to move forward and rearward.

5 Claims, 8 Drawing Sheets

ENDLESSLY CLOCKWISE/COUNTERCLOCKWISE IDLY ROTATABLE BURGULARPROOF DOOR LOCK

BACKGROUND OF THE INVENTION

The present invention relates to an endlessly clockwise/counterclockwise idly rotatable burglarproof door lock.

A conventional burglarproof door lock device is mainly used to prevent an outdoor burglar from intruding into a house, while failing to prevent a burglar from unlocking the door lock after entering the house. On the situation that the house has several compartments, the conventional door lock will be unable to prevent the burglar from first entering one of the compartments and then entering the other compartments from the first compartment, so that the burglar can easily open the door of each compartment and enter the living room or bed room. Therefore, it is necessary to provide a door lock which not only can prevent a burglar from opening the door outside, but also can prevent the burglar from opening the door inside.

SUMMARY OF THE INVENTION

It is therefore a primary object of the present invention to provide an endlessly clockwise and/or counterclockwise idly rotatable burglarproof door lock which is able to prevent a burglar from opening a door inside or outside the door. According to the above object, the door lock of the present invention includes a rotary switch assembly which has a rotary switch formed with a central projecting hub on a front surface thereof. The projecting hub has a recess frame, a notch and an engaging socket. A circular hole is formed on the rotary switch beside the projecting hub. A lock core body is disposed in the projecting hub. A rotary plate and a pushing plate are disposed on the lock core body. A first steel ball is disposed in the notch and a second steel ball and a spring are disposed in the circular hole. A copper ring is disposed on the front surface of the rotary switch. A circular orbit and a semicircular engaging hole are formed on the bottom of the copper ring. An engaging block of the door lock body is formed with a hook-like front end and restrained by a spring, whereby the engaging block can control a pushing block to move forward and rearward. When the lock core body is rotated by a key, the pushing plate continuously drives the rotary plate to rotate together until the pushing plate is rotated to an angle of 360 degrees. At this time, the arch projecting plate of the rotary plate touches a stopper block of the central hub and thus the rotary plate cannot be further rotated. At this time, the semicircular notch is departed from the notch, forcing the steel ball to move outward and go into the semicircular engaging hole of the copper ring, whereby the copper ring can drive the other components of the door lock to unlock the same. However, in case the steel ball is positioned between the semicircular notch of the rotary plate and the notch of the projecting hub before the key is inserted into the lock core, the copper ring cannot be driven by means of rotating the rotary switch, whereby the rotary switch can be freely rotated through 360 degrees clockwise or counterclockwise without unlocking the lock. Therefore, a burglar is prevented from unlocking the door lock by means of rotating the rotary switch, so that a burglar is prevented from opening the door inside the door. In addition, the engaging block is restrained by a spring and has an engaging recess at the front end for stopping the pushing block. When the door body contacts with the door lock, the engaging block is retracted into the door lock body. At this time, the engaging block cannot stop the pushing block so that the door lock is kept in an unlocked state.

The present invention can be best understood through the following description and accompanying drawing, wherein:

DETAILED DESCRIPTION OF THE PREFERRED EMBODIMENT

Figure 1:
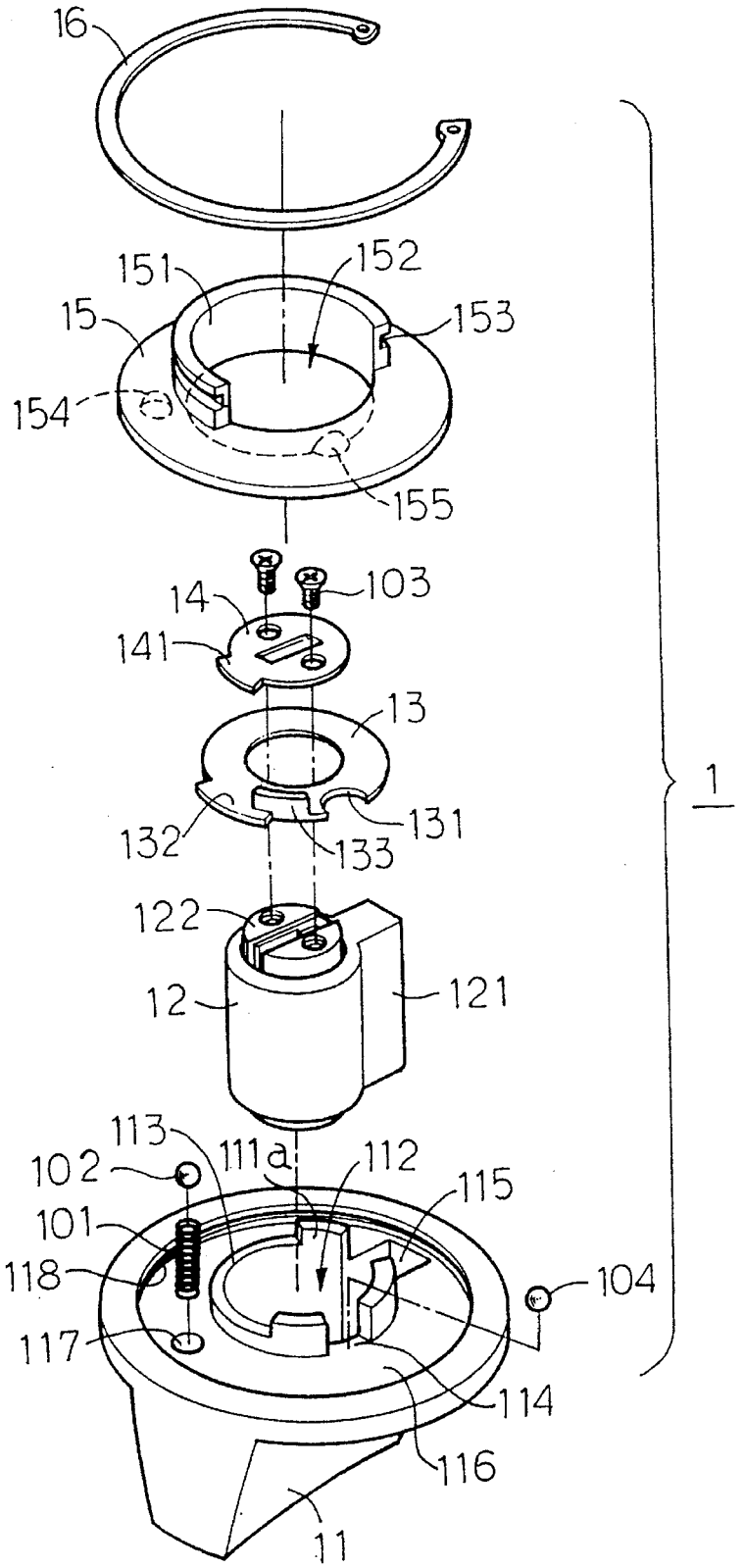
FIG. 1 is a perspective exploded view of the rotary switch assembly of the present invention.

Please refer to FIG. 1, wherein a rotary switch assembly 1 is composed of a rotary switch 11, a lock core body 12, a rotary plate 13, a pushing plate 14, a copper ring 15 and a C-shaped clip 16. The rotary switch 11 can be rotated/pushed by a user's thumb and index. A central hole 112 and a projecting hub 111 are formed on a central portion of a front face of the rotary switch. The projecting hub 111 has a recess frame 113, a notch 114 and an engaging socket 115. The recess frame 113 is located on a certain level, while the notch 114 is located on the same level as an annular groove 116 of the rotary switch. The engaging socket 115 is sunk to a position near a bottom of the rotary switch. A small circular hole 117 is formed on the annular groove 116 beside the projecting hub. A spring 101 and a steel ball 102 are disposed in the small circular hole. In addition, the lock core body 12 is disposed in the central hole 112. The lock core body 12 has a laterally projecting lock block 121 for engaging with the engaging socket 115. A lock core 122 is passed through the lock core body 12.

The rotary plate 13 is freely rotatably disposed on the lock core 122 in cascade. The pushing plate 14 is fixed on the lock core by two screws 103. The pushing plate has a lateral arch projecting plate 141 and the rotary plate 13 has a lateral semicircular notch 131 and a lateral arch projecting plate 132 as well as a projecting block 133 on the surface. In addition, the copper ring 15 is disposed on the surface of the annular groove 116 of the rotary switch 11 and the C-shaped clip 16 is inserted into a lateral insertion frame 118 of the annular groove so as to integrally associate the copper ring 15 with the rotary switch 11. The copper ring has a C-shaped projecting frame 151 and a shaft hole 152. The projecting frame 151 has an annular channel 153. The copper ring 15 has a circular orbit 154 and a semicircular engaging hole 155 on the bottom.

Figure 2:
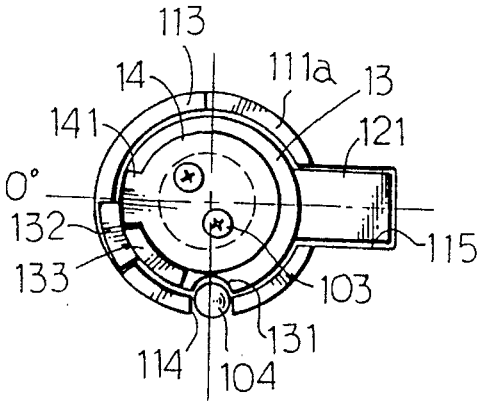
FIG. 2 is a top assembled view of the rotary switch assembly.
Figure 3:
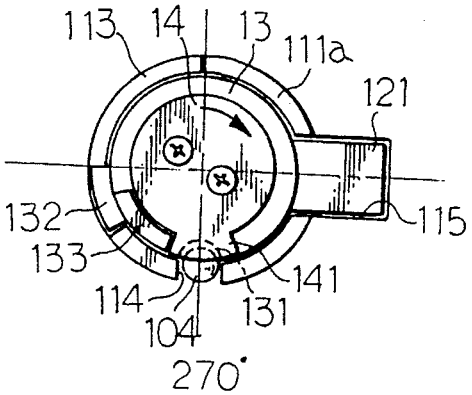
FIG. 3 shows a state of operation of the rotary switch assembly.
Figure 4:
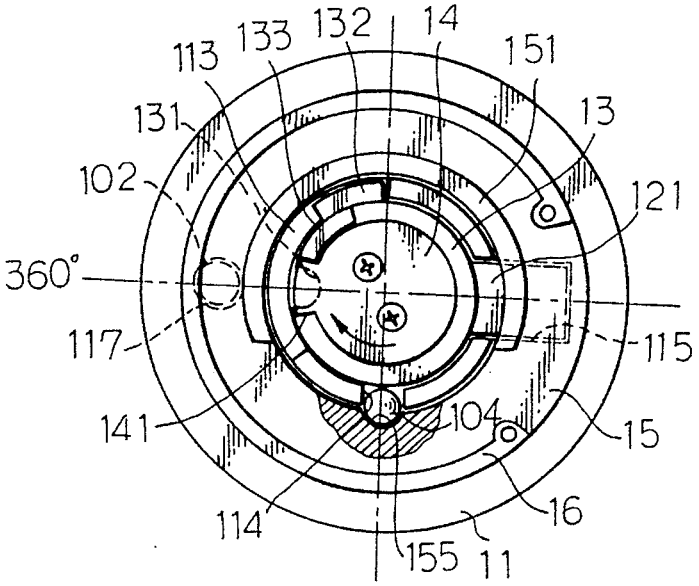
FIG. 4 shows another state of operation of the rotary switch assembly.

Please refer to FIG. 2 which shows a top assembled view of the rotary switch assembly 1, wherein the arch projecting plate 141 of the pushing plate 14 is horizontally positioned by an angle of 0 degree. When a right key is used to drive the lock core 122, the pushing plate is rotated to an angle of 270 degrees. At this time, the arch projecting plate 141 touches the projecting block 133 of the rotary plate 13 (as shown in FIG. 3), whereby the pushing plate 14 continuously drives the rotary plate 13 to rotate together until the pushing plate is rotated to an angle of 360 degrees. At this time, the arch projecting plate 132 of the rotary plate 13 touches a stopper block 111*a* of the central hub as shown in FIG. 4. The semicircular notch 131 of the rotary plate 13 and the notch 114 of the central hub are symmetrically arranged. A steel ball 104 is disposed between the semicircular notch 131 and the notch 114, whereby after the rotary plate 13 is rotated, the semicircular notch 114 is departed from the notch 114, forcing the steel ball 104 to move outward. At this time, if the semicircular engaging hole 155 of the copper ring 15 is aligned with the notch 114, then the steel ball 104 immediately moves to a position between the engaging hole 155 and the notch 114. At this time, the door lock is in a ready state to be unlocked, that is, once the rotary switch 11 is rotated, the copper ring 15 is driven to drive the other components of the door lock so as to unlock the door lock. This will be further described hereinafter.

When the steel ball 104 is positioned between the engaging hole 155 and the notch 114, the steel ball 102 inside the small circular hole 117 of the rotary switch 11 is pushed by the spring to fit into the orbit 154 of the copper ring 15. At this time, the user will have a sticking feeling and know that the steel ball 102 fits into small circular hole 117 and the other steel ball 104 is fitted between the engaging hole 155 and the notch 104. However, according to the above operation, the rotary switch 11 must be rotated prior to the rotation of the key, that is, after the steel ball 102 is fitted into the small circular hole 117, the key is used to rotate the rotary plate 13 so as to drive the pushing plate 14.

In case the steel ball 104 is positioned between the semicircular notch 131 of the rotary plate and the notch 114 of the projecting hub as shown in FIG. 2 before the key is inserted into the lock core, the copper ring 15 cannot be driven by means of rotating the rotary switch 11, whereby the rotary switch 11 can be freely rotated through 360 degrees clockwise or counterclockwise without unlocking the lock. Therefore, a burglar is prevented from unlocking the door lock by means of rotating the rotary switch. (In a conventional lock device, the door lock can be unlocked by means of rotating the rotary switch through a small angle.)

Figure 5:
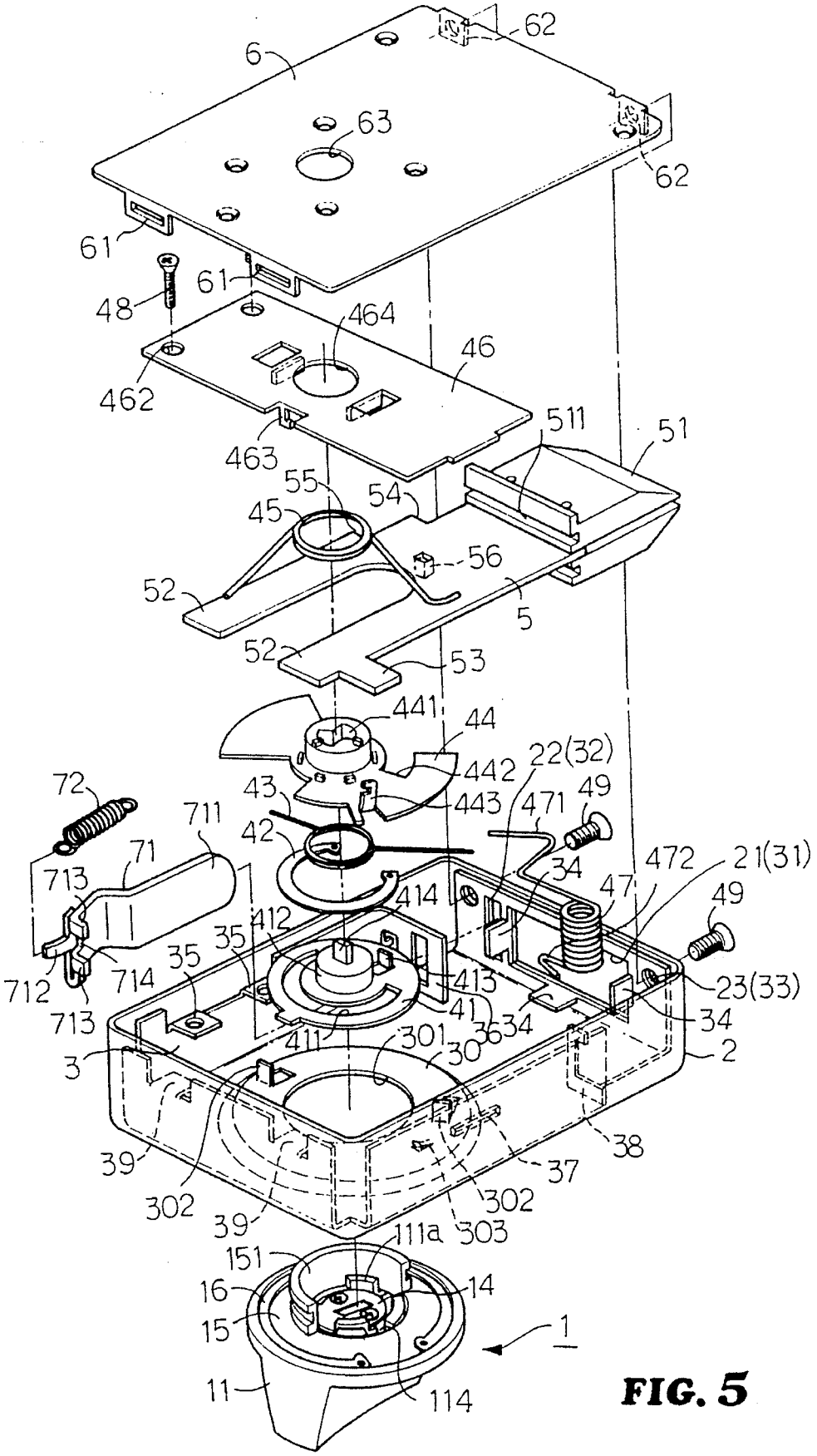
FIG. 5 is a perspective exploded view of the burglarproof door lock of the present invention.
Figure 6:
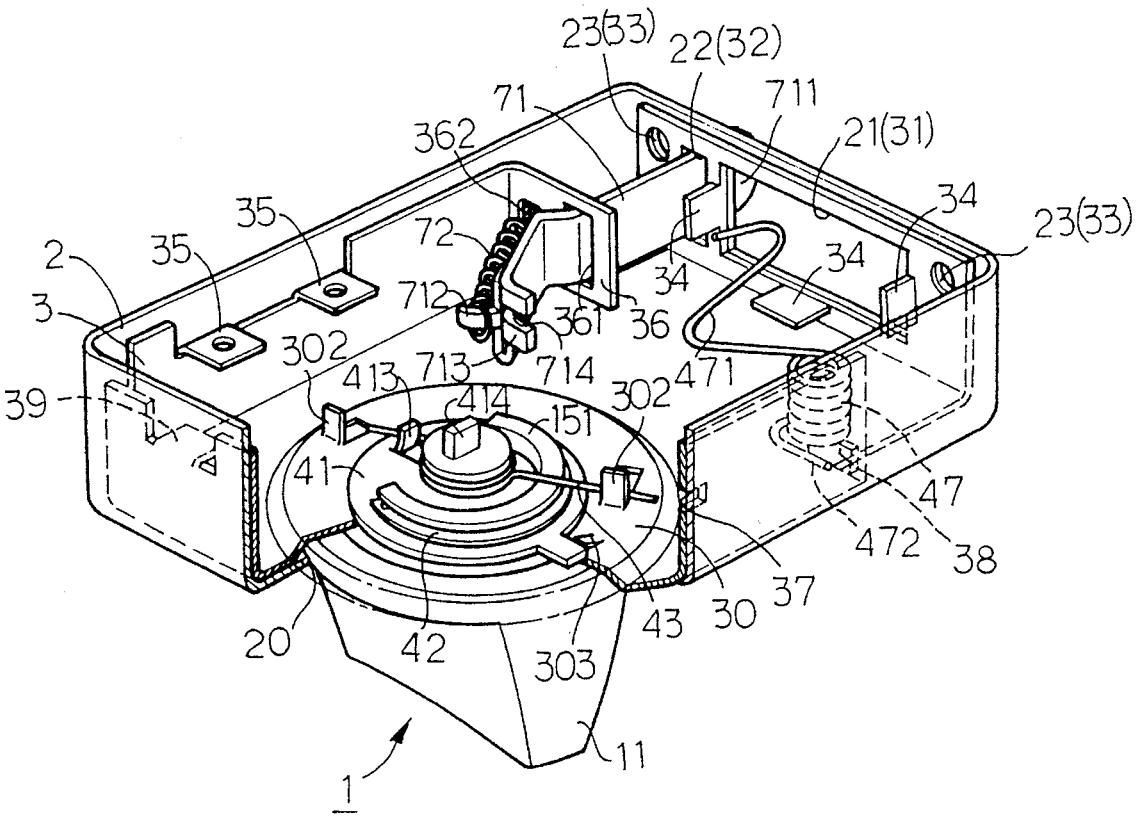
FIG. 6 is a perspective assembled view of the door lock body, inner housing and rotary switch assembly of the present invention.

Please refer to FIG. 5 which shows the rotary switch assembly 1, a door lock body 2, an inner housing 3, a transmission plate 41, a small clip ring 42, a compression spring 43, a brake plate 44, a pushing block 5, an engaging spring 45, a shaft cover 46, a pushing spring 47, a lock cover 6, an engaging block 71 and a pulling spring 72. The inner housing 3 is disposed in the door lock body 2 to define a rectangular window 21, 31 at one end. Two openings 23, 33 are formed on two sides of the window. A lateral window 22, 32 is formed beside the rectangular window. Three guide plates 34 are formed respectively at two ends and a bottom side of the rectangular window for guiding a lock block 51 of the pushing block 5 back and forth, whereby the lock block is prevented from deflecting or displacing left or right during moving. The inner housing 3 has two flange portions 35 on a lateral side for screws 48 to fix and an L-shaped block 36 for fixing the engaging block 7. On the other lateral side, the inner housing 3 has an elongated channel 37 and a perpendicular hook board 38. A projecting frame 461 of one end of the shaft cover 46 can be fitted into the elongated channel 37. The small holes of the flange portions 35 can be aligned with two small symmetric holes 462 of the other end of the shaft cover and fixed thereon by the screws 48. The pushing spring 47 is disposed on the perpendicular hook board 38 in cascade. The pushing spring has a long arm having a front V-shaped arm 471. The pushing spring has a bent arm 472 at the other end for hooking under the hook board 38 as shown in FIG. 6. In addition, the inner housing 3 has two symmetric engaging plates 39 at the other end for fitting into two engaging slots 61 of one end of the lock cover 6. The lock cover 6 has two flange portions 62 at the other end. The two flange portions 62 can be aligned with two small holes 32 of the inner housing 3 and fixed thereon by two screws 49.

The inner housing 3 has a circular convex board 30 formed with a central shaft hole 301. The convex board 30 cooperates with the circular hole 20 of the bottom of the door lock body 2 for the rotary switch assembly 1 to insert thereinto. The convex board has two projecting support legs 302 and a stopper plate 303. The support legs 302 are for supporting two support boards 52 of a rear end of the pushing block 5, while the stopper plate 303 is for stopping one of the support legs of the compression spring 43 as shown in FIG. 6.

The rotary switch assembly 1 is disposed under the bottom face of the convex board 30 with the C-shaped projecting frame 151 of the copper ring 15 passing through the shaft hole 301 into the C-shaped slot 411 of the transmission plate 41. The clip ring 42 is then inserted into the annular channel 153 of the C-shaped projecting frame so as to associate the copper ring 15 with the transmission plate 41. The compression spring 43 is disposed on the central rotary shaft 412 of the transmission plate in cascade. One of the support legs of the compression spring is hooked on the support leg 302 of the convex board of the inner housing 3 as mentioned above, while the other leg is hooked beside the support leg 413 on the surface of the transmission plate 41 as shown in FIG. 6, whereby the compression spring 43 is able to restore the copper ring 15 to its home position after rotated. In addition, the engaging block 71 is disposed in the window 361 of the L-shaped block 36. The engaging block 71 has a rear stem 711 protruding outside the lateral window 22 of the door lock body 2. The engaging block 71 further has a projecting hook 712 at the front end for hooking the pulling spring 72. The other end of the pulling spring 72 is hung on a projecting hook 362 of the L-shaped block 36. The engaging block 71 has a hook-like front end having two hooking claws 713 defining an engaging recess 714 therebetween.

The central rotary shaft 412 of the transmission plate 41 has a boss 414 for fitting into a central sector hole 441 of the brake plate 44. The brake plate 44 has a cut groove 442 and a hook lever 443 for hooking the long arm of the engaging spring 45. The other arm of the engaging spring is hooked on the hook lever 463 of the shaft cover 46.

Figure 7:
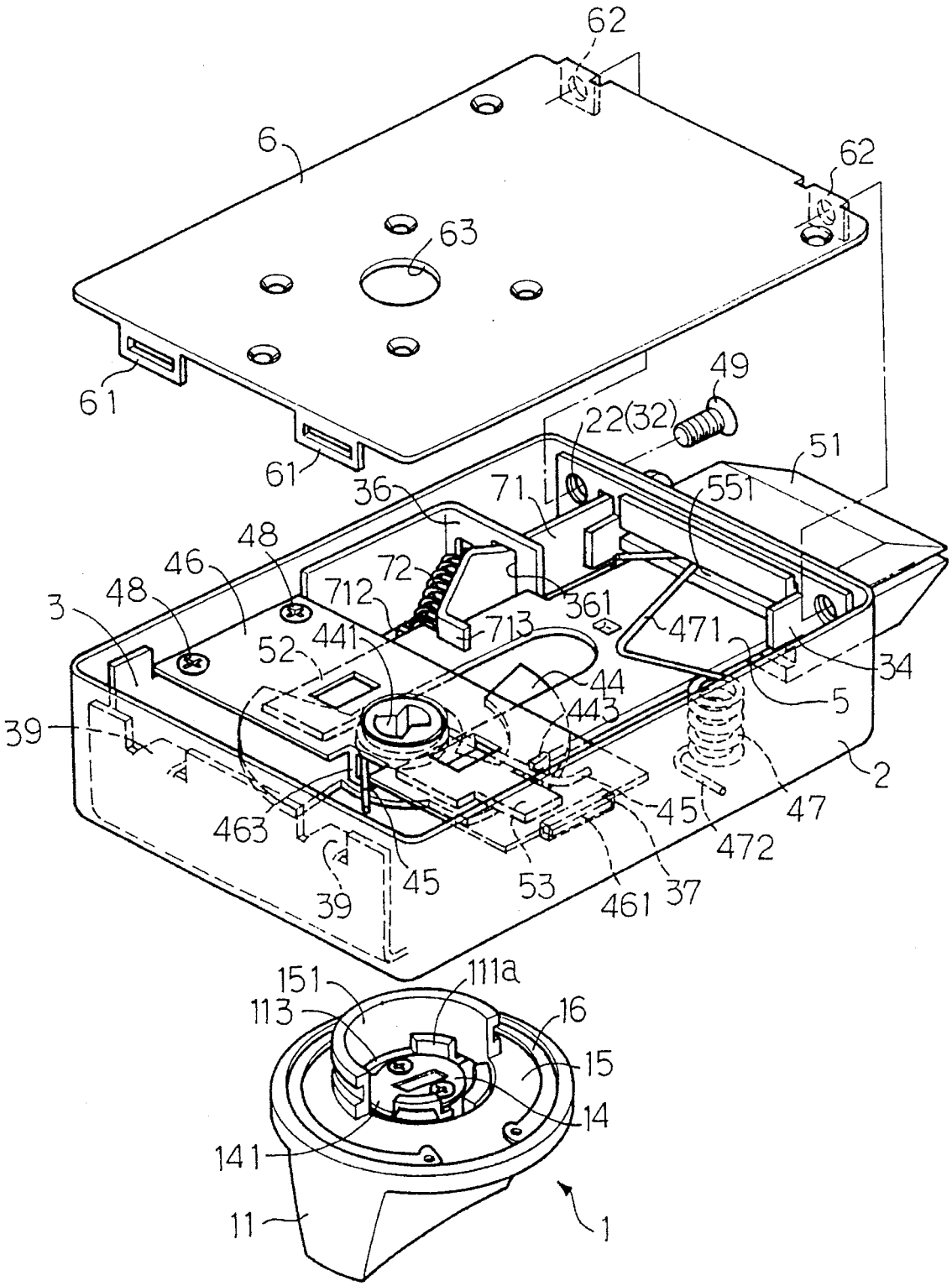
FIG. 7 is a perspective assembled view of the burglarproof door lock of the present invention.
Figure 8:
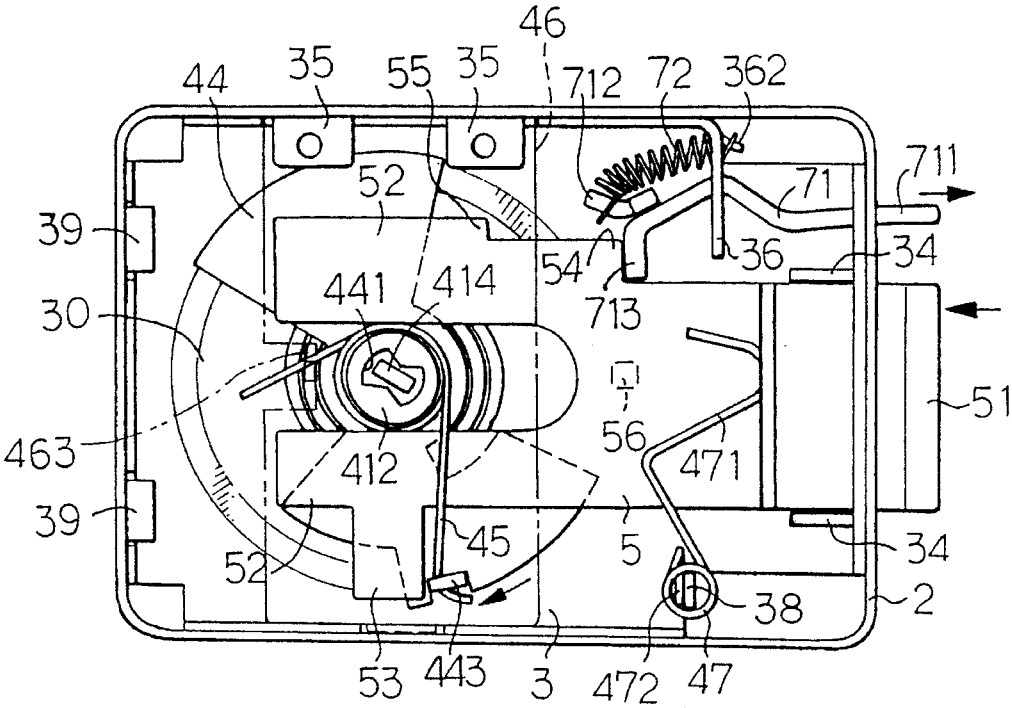
FIG. 8 is a top view thereof.
Figure 9:
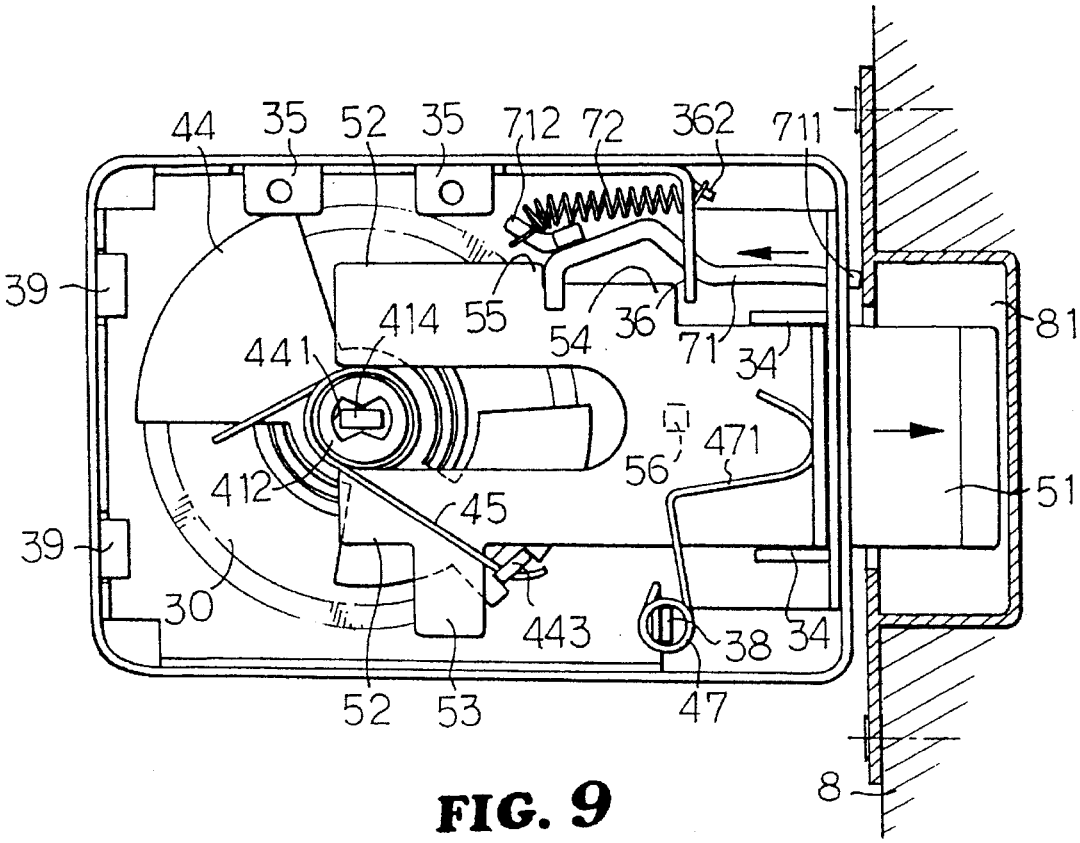
FIG. 9 shows a state of the operation thereof.

Please refer to FIG. 7. The V-shaped arm 471 of the pushing spring 47 is inserted into the rear channel 511 of the lock block 51. The pushing spring 47 is for pushing the lock block forward. The hook lever 443 of the brake plate 44 is higher than the rear projecting engaging block 53 of the pushing block 5. When the rotary switch 11 drives the copper ring 15, the transmission plate 41 is simultaneously driven to drive the brake plate 44. At this time, the hook lever 443 of the brake plate drives the engaging block, making the pushing block 5 and the lock block 51 move rearward as shown in FIG. 8. The door lock is unlocked at this time. Also, the engaging block 71 is affected by the pulling spring 72 to stop the lower projecting step 54 of the engaging block 5 so as to locate the engaging block 5 and prevent the engaging block 5 and the lock block 51 from further moving outward. Only after the rear stem 711 of the engaging block 7 is hit by the door body 8, the engaging block 71 will automatically retract into the door lock body as shown in FIG. 9. At this time, the front end of the engaging block can only stop the upper projecting step 55 of the lateral edge of the pushing block 5, while after the lock block 51 is pushed by the V-shaped arm 471 of the pushing spring 47, the pushing block automatically moves outward, making the lock block 51 go into the lock chamber 81 so as to unlock the lock.

Figure 10:
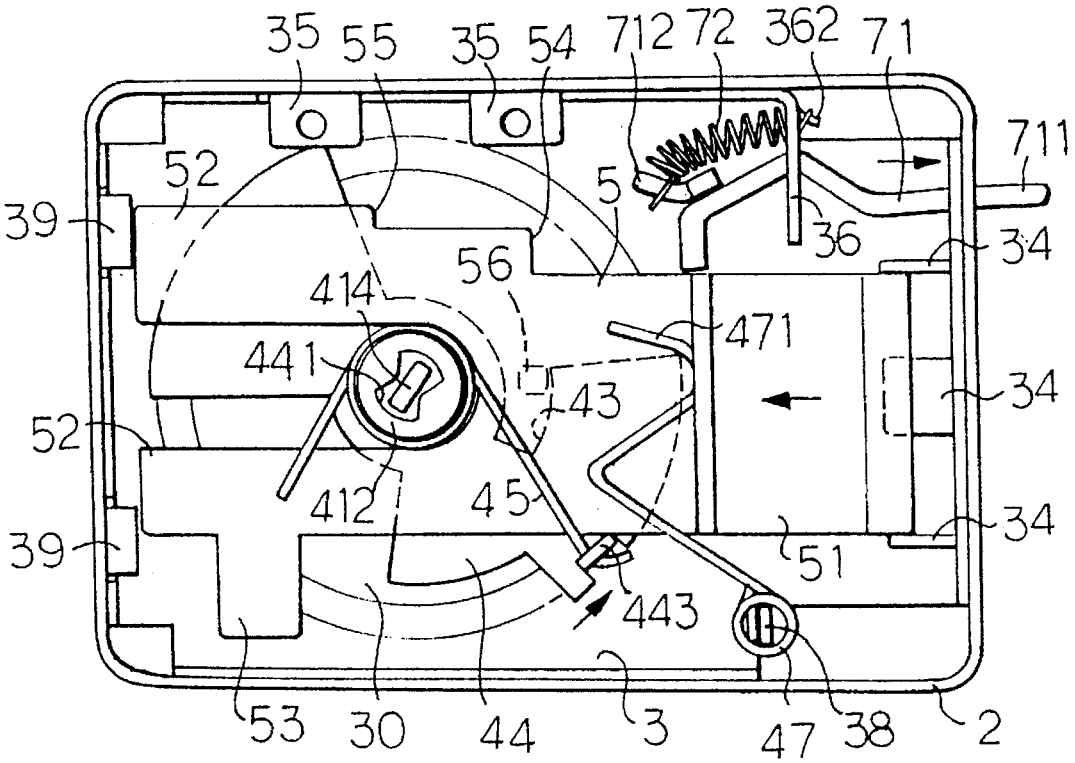
FIG. 10 shows another state of the operation thereof.

In addition, as shown in FIG. 10, after the lock block 51 is pressed into the door lock body 2 by the user's thumb, the hook lever 443 of the brake plate 44 is pushed by the long arm of the engaging spring 45 to rotate the brake plate 44, so that a central tenon 56 of the pushing block 5 is guided into the arch cut groove 442 of the brake plate 44. At this time, the pushing block 5 and the lock block 51 are prevented from further moving outward to form a totally unlocked state. This is generally performed on the situation that a person is inside the house.

Figure 11:
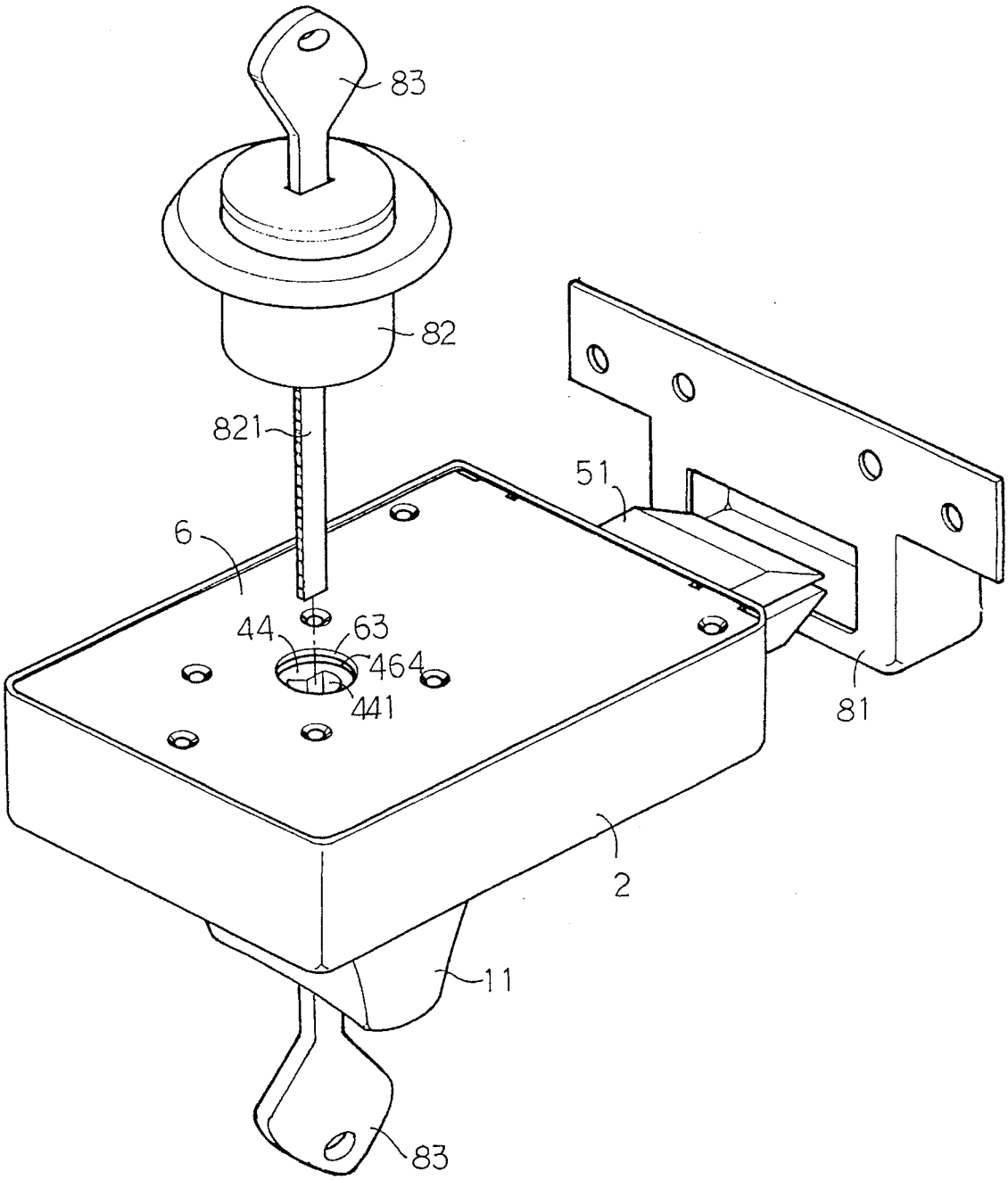
FIG. 11 shows that the present invention is applied in cooperation with a lock chamber and a door lock.

Please refer to FIG. 11. The burglarproof door lock of the present invention is disposed in cooperation with the door lock 82 installed outside the door and the lock chamber 81 fixed on the door frame. A lock lever 821 of the door lock 82 is passed through the circular hole 63 of the lock cover 6 and the circular hole 464 of the shaft cover 46 into the sector hole 441 of the brake plate 44. A key 83 is used to drive the lock lever 821 so as to unlock the burglarproof door lock 9. Also, the rotary switch assembly 1 can unlock the burglarproof door lock 9 by means of the same key 83. The lock chamber 81 is conventionally fixed on the door frame.

The present invention is characterized by the rotary switch assembly 1, engaging block 71, pushing spring 72 and the inner housing 3. The other components can be seen in the conventional burglarproof door lock device. However, these components are more or less improved over the conventional components.

It is to be understood that the above description and drawings are only used for illustrating one embodiment of the present invention, not intended to limit the scope thereof. Any variation and derivation from the above description and drawings should be included in the scope of the present invention.

What is claimed is:

1. An endlessly clockwise/counterclockwise idly rotatable burglarproof door lock, comprising a rotary switch assembly, a door lock body, an inner housing disposed in the door lock body, a transmission plate, a brake plate, a pushing block having a lock block at a front end thereof, a shaft cover, a lock cover, an engaging block, a pulling spring, a clip ring, an engaging spring, a pushing spring and several screws, said burglarproof door lock being characterized in that a rotary switch of the rotary switch assembly is formed with a central projecting hub on a front surface thereof, the projecting hub having a recess frame, a notch and an engaging socket, the engaging socket being communicated with a central hole of the rotary switch, a lock core body being disposed in the central hole of the rotary switch and the engaging socket, a rotary plate being disposed on a lock core of the lock core body in cascade, a pushing plate being fixed thereon by two screws, the pushing plate having an arch projecting plate, the rotary plate having a lateral semicircular notch and a lateral arch projecting plate and a projecting block on a surface thereof, the arch projecting plate of the pushing plate being able to push the projecting block of the rotary plate, whereby when the arch projecting plate of the rotary plate is stopped in the recess frame of the projecting hub, the pushing plate and rotary plate are prevented from rotating, a first steel ball being disposed between the semicircular notch of the rotary plate and the notch of the projecting hub, a copper ring being disposed on the rotary switch, having a shaft hole and a semicircular engaging hole on a bottom edge of the shaft hole, the semicircular engaging hole cooperating with the notch of the projecting hub for receiving the first steel ball, the copper ring being fitted in an annular groove of the front surface of the rotary switch and fixed therein by a C-shaped clip, the engaging block being passed through a window of an L-shaped block of the inner housing, the engaging block having a rear stem passing through a lateral window of the door lock body and a hook-like front end having two hook claws defining an engaging recess therebetween, the engaging block having a projecting hook for hooking the pulling spring, the other end of the pulling spring being hooked on a projecting hook of the L-shaped block, whereby the engaging block can be used to control the pushing block to move inward and outward and locate the pushing block.

2. A burglarproof door lock as claimed in claim 1, wherein a small circular hole is formed on the surface of the annular groove of the rotary switch beside the projecting hub thereof and a second steel ball and a spring are disposed in the small circular hole, a circular orbit being formed on the bottom of the copper ring, whereby the circular orbit can be aligned with the small circular hole, permitting the second steel ball to fit thereinto.

3. A burglarproof door lock as claimed in claim 1, wherein three guide plates are respectively disposed on two ends and bottom side of the rectangular window of the inner housing for guiding the lock block into and out of the window.

4. A burglarproof door lock as claimed in claim 1, wherein two flange portions are formed on one side of the inner housing and an L-shaped block is disposed beside the flange portions, an elongated channel being formed on the inner housing opposite to the flange portions, the flange portions cooperating with two small holes on a lateral side of the shaft cover for screws to fix the shaft cover on the inner housing, the other end of the shaft cover being fitted into the elongated channel of the inner housing.

5. A burglarproof door lock as claimed in claim 1, wherein two symmetric engaging plates are formed at one end of the inner housing for passing through two engaging slots of one end of the lock cover, two flange portions being formed at the other end of the lock cover to cooperate with two small holes of the other end of the inner housing for screws to fix the lock cover on the inner housing.

* * * * *